United States Patent [19]

Tomov et al.

[11] 4,295,943

[45] Oct. 20, 1981

[54] PROCESS FOR THE ELECTROLYTIC PRODUCTION OF MANGANESE DIOXIDE

[75] Inventors: Nenad R. Tomov; Geoffrey M. Roberts, both of Geneva, Switzerland

[73] Assignee: Diamond Shamrock Technologies S.A., Geneva, Switzerland

[21] Appl. No.: 141,199

[22] Filed: Apr. 17, 1980

[51] Int. Cl.[3] ..... C25B 1/18

[52] U.S. Cl. ..... 204/96

[58] Field of Search ..... 204/281, 96, 10

[56] References Cited

U.S. PATENT DOCUMENTS

| | | | |
|---|---|---|---|
| 2,099,873 | 11/1937 | Sternfels | 204/10 |
| 2,392,614 | 1/1946 | Prescott | 204/281 |
| 3,414,486 | 12/1968 | Nordblum et al. | 204/216 |
| 3,419,901 | 12/1968 | Nordblum | 204/10 |
| 3,855,088 | 12/1974 | Kosaka | 204/96 |
| 4,170,527 | 10/1979 | Beer et al. | 204/96 |

*Primary Examiner*—R. L. Andrews

*Attorney, Agent, or Firm*—Hammond & Littell, Weissenberger and Muserlian

[57] ABSTRACT

In a process for the production of manganese dioxide comprising electrodepositing manganese dioxide from an aqueous manganese containing electrolyte on to an anode and removing the manganese dioxide from the anode, the improvement comprising using a flexible material as the anode and flexing the anode to fracture and remove the manganese dioxde deposit.

8 Claims, No Drawings

PROCESS FOR THE ELECTROLYTIC PRODUCTION OF MANGANESE DIOXIDE

STATE OF THE ART

Electrolytic manganese dioxide is produced by electrolysis of a manganese-containing electrolyte such as a 0.5 to 1.2 mol/liter solution of manganous sulfate using titanium, a lead alloy or carbon as anode. The reaction scheme is:

| | |
|---|---|
| Anode: | $Mn^{2+} + H_2O \rightarrow MnO_2 + 4H^+ + 2e$ |
| Cathode: | $2H^+ + 2e \rightarrow H_2$ |
| Overall: | $Mn^{2+} + 2H_2O \rightarrow H_2 + MnO_2 + 2H^+$ |

An adherent layer of manganese dioxide is deposited on the anode and when the thickness of the deposit reaches a thickness of 10–30 mm or more, the anode is removed from the cell and stripped from the anode by impact, i.e. by hammering or even using an explosive. After cleaning, the anode is replaced in the cell and electrolysis is resumed. The manganese dioxide obtained is in the form of a large, hard block which is dried, crushed, washed and submitted to further treatment to obtain a powder thereof suitable for use as a dry cell depolarizer.

U.S. Pat. No. 3,855,088 indicates that in such a process, the anode is removed from the cell every 10 to 40 days for removal of the manganese dioxide deposit, but the cathode is used continuously. Because of impurities in the electrolyte, a cluster will build up on the cathode and lower the efficiency of the process, so that operation has to be interrupted every 5 to 6 months for removal of the strongly-adherent cathode cluster. Accordingly, U.S. Pat. No. 3,855,088 proposed to facilitate removal of this cluster by, every 6 months or so, connecting the cathode as an anode for about 3 to 10 hours to deposit $MnO_2$ onto the cluster which could then be removed, without damage to the electrode, by pulling it out of the electrolyte and applying an impact in the same way as the block of $MnO_2$ is removed from the anode.

It has been long recognized that the discontinuous "batch" process involving the stripping of anodically deposited $MnO_2$ has serious disadvantages, including the difficulty of grinding and otherwise processing the block of $MnO_2$ to a suitable particle size for use as a battery depolarizer. Also, the electrodes must be spaced apart by a distance which is sufficient to accommodate the $MnO_2$ deposit and as a consequence of the resulting high cell voltage, the process cannot be efficiently operated at current densities above about 200 $A/m^2$.

One unsuccessful attempt to obviate these disadvantages was the electrolysis of manganous nitrate using alternating current to produce particulate $MnO_2$ directly in the electrolyte without it being deposited on and removed from the anode. Another proposal described in U.S. Pat. No. 3,065,155, was to carry out electrolysis of an aqueous acidic solution of manganous sulfate, while agitating the electrolyte and maintaining a given concentration of $Mn^{3+}$ ions in a manner to precipitate particulate $MnO_2$ directly in the electrolyte. Moreover, the electrolyte containing about 350 g/l of sulfuric acid is very corrosive, which necessitates thorough and expensive washing, and the efficiency is lower than with the conventional batch process.

Another proposal for detaching $MnO_2$ from the electrode on which it has been anodically deposited is characterized by cathodically polarizing said electrode. With the electrode thus connected as cathode, when current passes through the electrolyte, it was found that under suitable conditions a substantial part of the deposited $MnO_2$ detached from the electrode in solid form, advantageously peeling off as flake-like particles.

British Pat. No. 1,539,008 describes a process for removing undesired deposits from electrodes of alkali metal and alkaline earth metal carbonates which inhibit flow of electrolyte and electric current in the cell by elastically deforming the electrode.

U.S. Pat. No. 4,177,113 relates to a hollow body cathode which when removed from the cell can be bowed inwardly by a vacuum.

OBJECTS OF THE INVENTION

It is an object of the invention to provide an improved process for production of electrolytic manganese dioxide wherein the deposit of $MnO_2$ can be removed in a simple fashion without removing the anode from the cell.

It is a further object of the invention to provide a process for electrolytic $MnO_2$ production wherein the particle size of the $MnO_2$ produced can be controlled.

These and other objects and advantages of the invention will become obvious from the following detailed description.

THE INVENTION

The novel process of the invention for the electrolytic production of manganese dioxide comprises electrolyzing an aqueous manganese containing electrolyte between a flexible anode and a cathode to deposit manganese dioxide on the anode, flexing the anode to fracture and remove the manganese dioxide deposited and recovering the manganese dioxide.

The thickness of the manganese dioxide deposit on the anode can vary between 100 to 2000 microns thick by appropriate selection of the operating conditions but a preferred thickness is 250 to 500 microns since the obtained particle size is better, being in the form of flake-like particles which are easily ground to a fine powder with excellent properties when used as a battery depolarizer.

The operating conditions are well known in the art but preferably the $Mn^{2+}$ concentration is 55 to 110 g/l and the interelectrodic gap is 5 to 15 mm. The current density may vary from 75 to 350 $A/m^2$ and the electrolysis temperature may be 85° to 98° C.

Various materials have been found suitable as electrodes. The main desirable qualities are inertness under electrolysis conditions in the electrolyte; a surface to which the deposit does not adhere too strongly; noncontaminating to the deposit; catalytic to manganese dioxide deposition and hydrogen evolution, and ability to flex.

Suitable anode materials or anode coating materials are: sandblasted valve metals or alloys of valve metals such as titanium, tantalum, zirconium and niobium (preferably used at current densities below 400 $A/m^2$), platinum group metals or their oxides; alloys or intermetallics of valve metals with platinum group metals; metal carbides, nitrides, borides, and sulfides, lead alloyed with silver and/or antimony; bronze oxides of the sodium tungstate type ($Na_xWO_3$, where $0<X\leqslant 1$); mixtures or mixed crystals of one or more platinum group metal oxides with one or more valve-metal oxides, possibly stabilized by other metal oxides such as $SnO_2$, $Sb_2O_5$ or rare earth metal oxides. An iridium oxide/tantalum oxide mixed crystal coating is very catalytic for $MnO_2$ formation and hydrogen evolution and operates with a very low power consumption; and valve metals having a thin surface oxide film impregnated with a very small quantity (up to about 0.5 g/m$^2$) of a platinum-group metal as metal or compound;

The cathode may be made of conventional materials such as stainless steel and other ferrous materials or graphite which is less desirable.

The anodes may be flexed by any suitable means such as mechanical horizontal bending of the anodes with a central bar while holding the edges rigid or by downward pressure applied to the top of the anodes whose base is secured at the bottom and release of the pressure effects stretching of the anode. Degree and direction of the flexing may be assisted in various ways. The cathodes may or may not be flexible depending on the cell construction.

The anodes may be in the form of thin, flexible sheets with an uniform anode surface but they may also be corrugated, patterned or straited which will control the type of cracking of the manganese dioxide deposit and the form of the resulting particle size. In the latter electrode, the anodes are provided with an uneven surface to aid in the fracture of the $MnO_2$ deposit by providing additional mechanical stress in the electrodeposit along this uneven surface. Any geometrical pattern may be formed on the electrode surface as long as the distance between adjacent profiles of the surface is not smaller than 5 mm.

In the following examples there are described several preferred embodiments to illustrate the invention. However, it should be understood that the invention is not intended to be limited to the specific embodiments.

EXAMPLE 1

An electrolytic cell with anodes made of thin titanium sheets and cathodes of stainless steel sheets measuring 10 cm×3 cm was used in this example and the anodes extended slightly higher than the sides of the cell. The electrode were secured to the base of the cell and a solid top plate rested on the anodes extending above the cell. A downward pressure on the top plate caused the anodes to flex and the pressure was then released.

Electrolyte consisting of 1.5 to 2 moles of manganese sulfate and 0.25 moles of sulfuric acid was added to the cell and electrolysis was effected at a temperature of 90° to 98° C. with a current density of 75 to 250 A/m$^2$. The cell voltage was 1.85 volts and the interelectrodic gap was 10 mm. The manganese 2+ concentration was adjusted by periodic addition of manganese carbonate. The electrolysis was operated for 20 hours until a deposit 500 microns thick was obtained after which the anodes were flexed and the manganese dioxide particles were removed from the cell. The process was repeated for 10 cycles and the total amount of manganese dioxide recovered was 280 g greater with an average particle size of 4 mm.

EXAMPLE 2

The process of Example 1 was repeated using electrodes which were provided with grooves about 4 to 5 mm apart running horizontally or vertically or both. The electrodes were used for 10 cycles of electrodeposition of $MnO_2$ of 2 hours per cycle. The deposit of $MnO_2$ was about 50 microns. The manganese dioxide particles had an average particle size of 1 to 2 mm.

EXAMPLE 3

The process of Example 1 was repeated with the surface of the titanium anodes being grooved horizontally or vertically with grooves 4 to 5 mm wide spaced less than 1 mm apart and about 100 to 300 microns deep. The manganese dioxide particles had an average particle size of 2 to 3 mm and were more uniform than the particles of Example 1.

Various modifications of the process and product of the invention may be made without departing from the spirit or scope thereof and it should be understood that the invention is intended to be limited only as defined in the appended claims.

We claim:

1. A process for the electrolytic production of manganese dioxide comprising electrolyzing an aqueous manganese containing electrolyte between a flexible anode and a cathode to deposit manganese dioxide on the anode, flexing the anode to fracture and remove the manganese dioxide deposit and recovering the manganese dioxide without removing the anode from the cell.

2. The process of claim 1 wherein the manganese dioxide deposit is between 100 to 2000 microns thick at the time of flexing.

3. The process of claim 1 wherein the concentration of $Mn^{2+}$ is 55 to 100 g/l.

4. The process of claim 1 wherein the current density is 75 to 350 A/m$^2$ and the electrolyte temperature is 85° to 98° C.

5. In a process for the production of manganese dioxide comprising electrodepositing manganese dioxide from an aqueous manganese containing electrolyte on to an anode and removing the manganese dioxide from the anode, the improvement comprising using a flexible material as the anode and the anode surface is provided with a plurality of grooves and flexing the anode to fracture and remove the manganese dioxide deposit without removing the anode from the cell.

6. The process of claim 5 wherein the grooves are horizontal.

7. The process of claim 5 wherein the grooves are vertical.

8. The process of claim 5 wherein the manganese dioxide deposit is between 100 and 2000 microns thick at the time of flexing.

* * * * *